US006241203B1

(12) United States Patent
Cukrov

(10) Patent No.: US 6,241,203 B1
(45) Date of Patent: Jun. 5, 2001

(54) ADJUSTABLE TOOTHBRUSH HOLDER

(76) Inventor: Sue Cukrov, 391 Ardis Ave., San Jose, CA (US) 95117

( * ) Notice: Subject to any disclaimer, the term of this patent is extended or adjusted under 35 U.S.C. 154(b) by 0 days.

(21) Appl. No.: 09/439,340

(22) Filed: Nov. 12, 1999

(51) Int. Cl.[7] ..... A46B 17/02
(52) U.S. Cl. ..... 248/110
(58) Field of Search ..... 248/110, 113, 248/111, 112; 40/620, 658, 665; 15/248.1

(56) References Cited

U.S. PATENT DOCUMENTS

| | | | | |
|---|---|---|---|---|
| D. 341,510 | | 11/1993 | Lieberman . | |
| 1,023,641 | | 4/1912 | Greer . | |
| 2,626,199 | | 1/1953 | Kmowles . | |
| 2,703,652 | * | 3/1955 | Dominik | 248/113 X |
| 2,917,182 | | 12/1959 | Browne . | |
| 2,956,851 | | 10/1960 | Merendino . | |
| 3,462,789 | * | 8/1969 | Seal | 248/113 X |
| 3,977,743 | | 8/1976 | Harris . | |

* cited by examiner

*Primary Examiner*—Ramon O. Ramirez

(57) ABSTRACT

A adjustable toothbrush holder for holding toothbrushes of varying sizes. The adjustable toothbrush holder includes a base, two rods and a bar. The base has a top surface and a bottom surface. A securing means secures the base to the vertical surface. The first rod has a first end, a second end, and a middle portion. The first end of the first rod is fixedly mounted to the top surface of the base. The second rod is substantially identical to the first rod. The first end of the second rod is fixedly mounted to the top surface of the base. The bar holds the toothbrush against the top surface of the base. The bar has a first end portion and a second end portion. The first and second end portions each have a bore therethrough. The first rod extends through the bore on the first end portion of the bar, and the second rod extends through the bore on the second end portion of the bar.

9 Claims, 1 Drawing Sheet

ADJUSTABLE TOOTHBRUSH HOLDER

BACKGROUND OF THE INVENTION

1. Field of the Invention

The present invention relates to tooth brush holders and more particularly pertains to a new adjustable toothbrush holder for holding toothbrushes of varying sizes.

2. Description of the Prior Art

The use of tooth brush holders is known in the prior art. More specifically, tooth brush holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,626,199; U.S. Pat. No. 2,917,182; U.S. Pat. No. 3,977,743; U.S. Pat. No. 1,023,641; U.S. Pat. No. 2,956,851; and U.S. Pat. Des. No. 341,510.

While these devices fulfill their respective, particular objectives and requirements, the aforementioned patents do not disclose a new adjustable toothbrush holder. The inventive device includes a base, two rods and a bar. The base has a top surface and a bottom surface. A securing means secures the base to the vertical surface. The first rod has a first end, a second end, and a middle portion. The first end of the first rod is fixedly mounted to the top surface of the base. The second rod is substantially identical to the first rod. The first end of the second rod is fixedly mounted to the top surface of the base. The bar holds the toothbrush against the top surface of the base. The bar has a first end portion and a second end portion. The first and second end portions each have a bore therethrough. The first rod extends through the bore on the first end portion of the bar, and the second rod extends through the bore on the second end portion of the bar.

In these respects, the adjustable toothbrush holder according to the present invention substantially departs from the conventional concepts and designs of the prior art, and in so doing provides an apparatus primarily developed for the purpose of holding toothbrushes of varying sizes.

SUMMARY OF THE INVENTION

In view of the foregoing disadvantages inherent in the known types of tooth brush holders now present in the prior art, the present invention provides a new adjustable toothbrush holder construction wherein the same can be utilized for holding toothbrushes of varying sizes.

The general purpose of the present invention, which will be described subsequently in greater detail, is to provide a new adjustable toothbrush holder apparatus and method which has many of the advantages of the tooth brush holders mentioned heretofore and many novel features that result in a new adjustable toothbrush holder which is not anticipated, rendered obvious, suggested, or even implied by any of the prior art tooth brush holders, either alone or in any combination thereof.

To attain this, the present invention generally comprises a base, two rods and a bar. The base has a top surface and a bottom surface. A securing means secures the base to the vertical surface. The first rod has a first end, a second end, and a middle portion. The first end of the first rod is fixedly mounted to the top surface of the base. The second rod is substantially identical to the first rod. The first end of the second rod is fixedly mounted to the top surface of the base.

The bar holds the toothbrush against the top surface of the base. The bar has a first end portion and a second end portion. The first and second end portions each have a bore therethrough. The first rod extends through the bore on the first end portion of the bar, and the second rod extends through the bore on the second end portion of the bar.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable toothbrush holder apparatus and method which has many of the advantages of the tooth brush holders mentioned heretofore and many novel features that result in a new adjustable toothbrush holder which is not anticipated, rendered obvious, suggested, or even implied by any of the prior art tooth brush holders, either alone or in any combination thereof.

It is another object of the present invention to provide a new adjustable toothbrush holder which may be easily and efficiently manufactured and marketed.

It is a further object of the present invention to provide a new adjustable toothbrush holder which is of a durable and reliable construction.

An even further object of the present invention is to provide a new adjustable toothbrush holder which is susceptible of a low cost of manufacture with regard to both materials and labor, and which accordingly is then susceptible of low prices of sale to the consuming public, thereby making such adjustable toothbrush holder economically available to the buying public.

Still yet another object of the present invention is to provide a new adjustable toothbrush holder which provides in the apparatuses and methods of the prior art some of the advantages thereof, while simultaneously overcoming some of the disadvantages normally associated therewith.

Still another object of the present invention is to provide a new adjustable toothbrush holder for holding toothbrushes of varying sizes.

Yet another object of the present invention is to provide a new adjustable toothbrush holder which includes a base, two rods and a bar. The base has a top surface and a bottom surface. A securing means secures the base to the vertical surface. The first rod has a first end, a second end, and a middle portion. The first end of the first rod is fixedly mounted to the top surface of the base. The second rod is substantially identical to the first rod. The first end of the second rod is fixedly mounted to the top surface of the base. The bar holds the toothbrush against the top surface of the base. The bar has a first end portion and a second end portion. The first and second end portions each have a bore therethrough. The first rod extends through the bore on the first end portion of the bar, and the second rod extends through the bore on the second end portion of the bar.

Still yet another object of the present invention is to provide a new adjustable toothbrush holder that holds a toothbrush on a vertical wall to prevent a toothbrush from sitting in a unsanitary cup or holder.

Even still another object of the present invention is to provide a new adjustable toothbrush holder that allows the toothbrush handle to dry quicker due to exposure to air.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
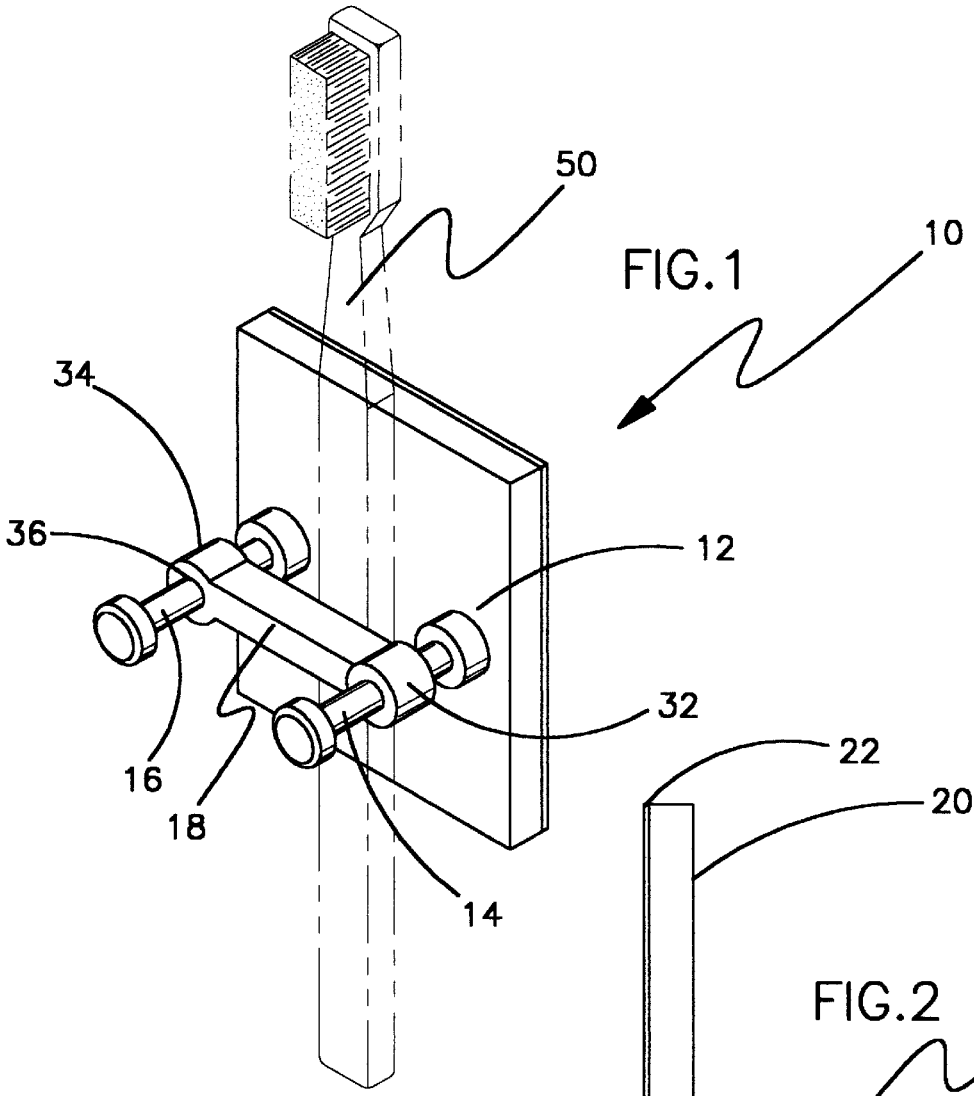
FIG. 1 is a schematic perspective view of a new adjustable toothbrush holder according to the present invention.
Figure 2:
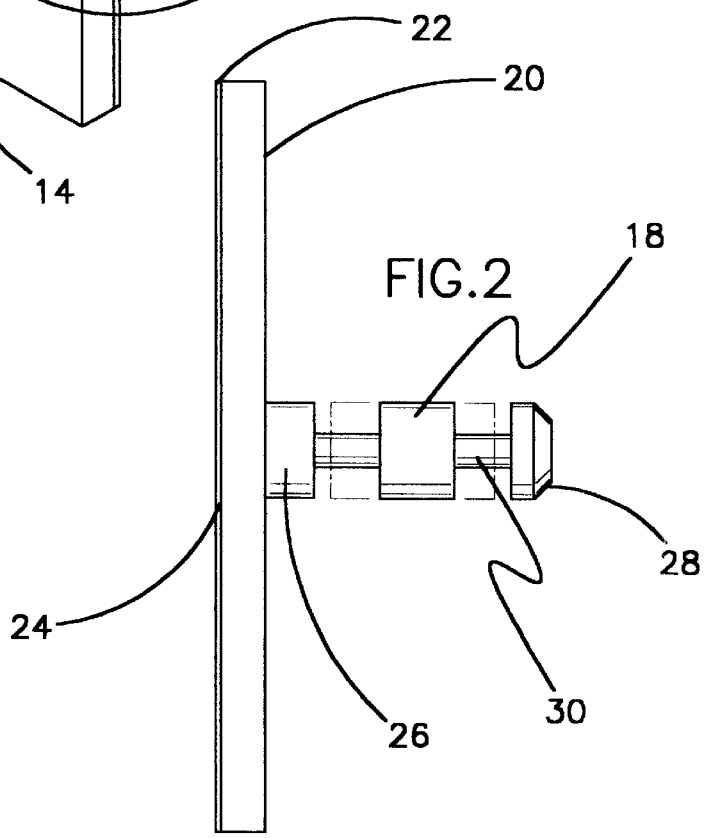
FIG. 2 is a schematic side view of the present invention.

With reference now to the drawings, and in particular to FIGS. 1 and 2 thereof, a new adjustable toothbrush holder embodying the principles and concepts of the present invention and generally designated by the reference numeral 10 will be described.

As best illustrated in FIGS. 1 and 2, the adjustable toothbrush holder 10 generally comprises a base 12, two rods 14, 16 and a bar 18.

The base 12 has a top surface 20 and a bottom surface 22. The base has two pair of opposing edges and is preferably rectangular shaped.

Ideally, an adhesive 24 secures the base 12 to the vertical surface and is on the bottom surface of the base. The adhesive can be any number of adhesives well known in the art.

The first rod 14 has a first end 26, a second end 28, and a middle portion 30. Preferably, each of the ends 26, 28 has a perimeter length greater than a perimeter length of the middle portion 30 of the first rod 14. The first end 26 of the first rod 14 is fixedly mounted to the top surface 20 of the base 12. Ideally, the first rod 14 is orientated generally perpendicular to a plane of the top surface 20 of the base 12. The first rod 14 extends away from the top surface 20 of the base 12 and preferably has a generally cylindrical shape.

The second rod 16 is substantially identical to the first rod 14. A first end of the second rod 16 is fixedly mounted to the top surface 20 of the base 12, wherein the first 14 and second 16 rods are located along a line generally parallel to a pair of opposing edges of the base 12 such that the line is horizontal when the device is mounted on a vertical surface.

The bar 18 for holding the toothbrush 50 against the top surface of the base has a first end portion 32 and a second end portion 34. The first 32 and second 34 end portions each have a bore 36 therethrough. The middle portion 30 of the first rod 14 extends through the bore 36 on the first end portion 31 of the bar 18. The middle portion of the second rod 16 extends through the bore 36 on the second end portion 34 of the bar 18. Wherein the bar 18 is slidable on the first 14 and second 16 rods when finger applied force but wherein sufficient friction exists between the bores 36 of the bar 18 and the rods 14, 16 such that the bar 18 is able to hold its position on the rods 14, 16 when finger force is removed from the bar.

In use, the bar 18 is slid on the rods 14, 16 to the correct distance from the base 12 in order to place a toothbrush 50 between the top surface 20 of base 12 and the bar 18.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toothbrush holder for holding a toothbrush on a vertical surface, comprising:

a base, said base having a top surface and a bottom surface:

a means for securing said base to the vertical surface;

a first rod, said first rod having a first end, a second end, and a middle portion, said first end of said first rod being fixedly mounted to said top surface of said base;

a second rod, said second rod being substantially identical to said first rod, a first end of said second rod being fixedly mounted to said top surface of said base; and a bar for holding the toothbrush against the top surface of the base, said bar having a first end portion and a second end portion, said first and second end portions each having a bore therethrough, said first rod extending through said bore on said first end portion of said bar, said second rod extending through said bore on said second end portion of said bar; and wherein said first and second rods comprise:

said first and second rods each having first and second ends having a perimeter length greater than a perimeter length of said middle portion of said first rod.

2. The toothbrush holder for holding a toothbrush on a vertical surface as in claim 1, said holder comprises:

said base having two pair of opposing edges, said base having a generally rectangular shape; and said securing means being an adhesive for securing said base to the vertical surface, said adhesive being on said bottom surface of said base.

3. A toothbrush holder for holding a toothbrush on a vertical surface, comprising:

a base, said base having a top surface and a bottom surface:

a means for securing said base to the vertical surface;

a first rod, said first rod having a first end, a second end, and a middle portion, said first end of said first rod being fixedly mounted to said top surface of said base;

a second rod, said second rod being substantially identical to said first rod, a first end of said second rod being fixedly mounted to said top surface of said base; and a bar for holding the toothbrush against the top surface of the base, said bar having a first end portion and a second end portion, said first and second end portions each having a bore therethrough, said first rod extending through said bore on said first end portion of said bar, said second rod extending through said bore on said second end portion of said bar; and wherein said first and second rods comprise:

said first and second rods each having first and second ends having a perimeter length greater than a perimeter length of said middle portion of said first rod.

4. The toothbrush holder for holding a toothbrush on a vertical surface as in claim 2, wherein said first and second rods are located along a line generally parallel to a pair of opposing edges of said base.

5. The toothbrush holder for holding a toothbrush on a vertical surface as in claim 1, wherein holder comprises:

said middle portion of said first rod extending through said bore on said first end portion of said bar, said middle portion of said second rod extending through said bore on said second end portion of said bar, wherein said bar is slidable on said first and second rods with finger applied force but wherein sufficient friction exists between said bores of said bar and said rods such that said bar is able to hold its position on said rods when finger force is removed from said bar.

6. A toothbrush holder for holding a toothbrush on a vertical surface, comprising:

a base, said base having a top surface and a bottom surface, said base having two pair of opposing edges, said base having a generally rectangular shape:

an adhesive for securing said base to the vertical surface, said adhesive being on said bottom surface of said base;

a first rod, said first rod having a first end, a second end, and a middle portion, each of said ends having a perimeter length greater than a perimeter length of said middle portion of said first rod, said first end of said first rod being fixedly mounted to said top surface of said base, said first rod being orientated generally perpendicular to a plane of said top surface of said base, said first rod extending away from said top surface of said base, said first rod having a generally cylindrical shape;

a second rod, said second rod being substantially identical to said first rod, a first end of said second rod being fixedly mounted to said top surface of said base, wherein said first and second rods are located along a line generally parallel to a pair of opposing edges of said base;

a bar for holding the toothbrush against the top surface of the base, said bar having a first end portion and a second end portion, said first and second end portions each having a bore therethrough, said middle portion of said first rod extending through said bore on said first end portion of said bar, said middle portion of said second rod extending through said bore on said second end portion of said bar, wherein said bar is slidable on said first and second rods with finger applied force but wherein sufficient friction exists between said bores of said bar and said rods such that said bar is able to hold its position on said rods when finger force is removed from said bar.

7. A toothbrush holder for holding a toothbrush on a vertical surface, comprising:

a base, said base having a top surface and a bottom surface:

a means for securing said base to the vertical surface;

a first rod, said first rod having a first end, a second end, and a middle portion, said first end of said first rod being fixedly mounted to said top surface of said base;

a second rod, said second rod being substantially identical to said first rod, a first end of said second rod being fixedly mounted to said top surface of said base; and a bar for holding the toothbrush against the top surface of the base, said bar having a first end portion and a second end portion, said first and second end portions each having a bore therethrough, said first rod extending through said bore on said first end portion of said bar, said second rod extending through said bore on said second end portion of said bar.

8. The toothbrush holder for holding a toothbrush on a vertical surface as in claim 7, said holder comprises:

said base having two pair of opposing edges, said base having a generally rectangular shape; and said securing means being an adhesive for securing said base to the vertical surface, said adhesive being on said bottom surface of said base.

9. The toothbrush holder for holding a toothbrush on a vertical surface as in claim 7, wherein said first and second rods are located along a line generally parallel to a pair of opposing edges of said base.

* * * * *